US005957515A

United States Patent [19]

Van Der Sluys

[11] Patent Number: 5,957,515

[45] Date of Patent: Sep. 28, 1999

[54] INFANT TOY GRIPPING ASSISTANCE DEVICE

[76] Inventor: Cherie H. Van Der Sluys, 430 Owls Roost, Huntington, Conn. 06484

[21] Appl. No.: 09/007,632

[22] Filed: Jan. 15, 1998

Related U.S. Application Data

[60] Provisional application No. 60/035,697, Jan. 17, 1997.

[51] Int. Cl.[6] ..... A45F 5/00

[52] U.S. Cl. ..... 294/25; 224/218; 224/220; 224/250; 224/901.4; 446/26; 24/3.13

[58] Field of Search ..... 224/220, 218, 224/217, 219, 221, 901.4, 250, 148.6; 294/25; 24/3.13; 482/44, 49, 50, 139, 105, 106, 108; D3/215; 30/298; 623/65; 446/26, 419, 421

[56] References Cited

U.S. PATENT DOCUMENTS

| | | | |
|---|---|---|---|
| D. 305,961 | 2/1990 | Cobb | 224/220 |
| D. 357,801 | 5/1995 | Short | D3/215 |
| 452,830 | 5/1891 | Bowie et al. | 224/220 |
| 2,539,698 | 1/1951 | Pearson | 248/104 |
| 5,505,353 | 4/1996 | Marsh, Jr. | 224/148.6 |
| 5,743,450 | 4/1998 | Plate | 224/220 |

FOREIGN PATENT DOCUMENTS

| | | | |
|---|---|---|---|
| 335 438 | 4/1921 | Germany | 224/220 |

OTHER PUBLICATIONS

Excerpt from AliMed® Products Catalog (4 pp.) Relevant pages are pages S140 and S255; AliMed® Inc. [only information available].

Excerpt from Smith & Nephew Rolyan Rehabilitation Products Catalog 1995 (7 pp.) Relevant pages are pp. 78–81 and 15A; Smith & Nephew Rolyan Inc. [only information available].

*Primary Examiner*—Linda J. Sholl

*Attorney, Agent, or Firm*—Ware, Fressola, Van Der Sluys & Adolphson LLP

[57] ABSTRACT

A device for assisting an infant with gripping a toy is disclosed. In the preferred embodiment, the device comprises a first toy-loop, for engaging a first portion of a toy, a second toy-loop, for engaging a second portion of a toy, a hand-strap, for connecting the first and second toy loops, a wrist-band, and a connecting strip, for connecting the wrist-band to the hand-strap. When properly placed on an infant, the wrist-band and hand-strap keep the toy positioned near the infant's hand in case the infant releases his/her grip on the toy so that the toy can be readily gripped again. Furthermore, the infant's hand is disposed between the toy and the hand-strap, thereby positioning the toy near the infant's palm for easy gripping by the infant.

17 Claims, 3 Drawing Sheets

INFANT TOY GRIPPING ASSISTANCE DEVICE

This patent application claims priority to the provisional patent application bearing application Ser. No. 60/035,697, filed on Jan. 17, 1997.

BACKGROUND OF THE INVENTION

1. Field Of The Invention

The present invention relates generally to a device that removably attaches to an infant's hand and which also can secure an object such as a toy thereto so as to assist, encourage and teach the infant to grip the toy.

2. Discussion of Related Art

In the prior art, there is a device commonly referred to as a "universal cuff", designed to assist individuals with motor skill deficiencies to hold utensils, such as a fork or spoon. The "universal cuff" is a band of material that slides onto a person's hand, and is adjustable to hold the "universal cuff" on differently sized hands. A pocket is provided in the "universal cuff" for accommodating the handle of a utensil, such as a fork or spoon. "Universal cuffs" are designed to assist people who know how, but are physically unable to properly grip such utensils. The "universal cuff" is not appropriate for keeping a toy in an infant's hand because the infant can easily slide the "universal cuff" off his or her hand.

In addition, because the "universal cuff" continuously contacts the palm of the hand the "universal cuff" provides continuous sensory feed-back to the user. Such continuous feed-back is not helpful to teaching an infant to grip a toy because it is desirable to give as little sensory feed-back as possible when the infant is not gripping the toy and as much sensory feed-back as possible when the infant is gripping the toy. By providing a large difference in sensory feed-back between the gripping and non-gripping states, an infant should learn to grip faster. Furthermore, by having the palm partially covered by the strap of the "universal cuff", the infant would not learn to associate gripping with the sensory feed-back normally associated with the covered area. This might cause the infant to rely on other sensory feed-back (e.g. vision) to determine whether he/she is gripping an object. Such reliance on other sensory feed-back is not preferable because infants should be encouraged to utilize and develop all forms of sensory feed-back.

Also in the prior art are various devices used to removably attach a pacifier to the clothing of an infant. For example, one such device uses a spring biased clip and a piece of flexible nylon fabric to attach a pacifier to an infant's clothing. The clip is secured to the infant's clothing at about the middle of the infant's chest. The nylon fabric is attached at one end to the clip, and at the other end to the pacifier, and is long enough to permit the infant to have the pacifier in his/her mouth. When the infant removes the pacifier from his/her mouth, the pacifier is prevented from falling to the floor by the device. However, once the pacifier leaves the infant's mouth, assistance is required to put the pacifier back in the infant's mouth.

SUMMARY OF THE INVENTION

Accordingly, it is an object of the present invention to assist and encourage an infant to grip an object such as a toy.

It is also an object of the present invention to provide a device for keeping a toy in close proximity to an infant's hand once the infant has stopped gripping the toy.

The foregoing objectives are realized by the gripping assistance device of the present invention which comprises a wrist-band, a first toy-loop, a second toy-loop and a means for connecting the wrist-band with the first and the second toy-loops.

Other objects and advantages of the present invention will become apparent to those skilled in the art from the following detailed description read in conjunction with the attached drawings and claims appended hereto.

BRIEF DESCRIPTION OF THE DRAWINGS

For a fuller understanding of the nature and objects of the invention, reference should be made to the following detailed description taken in conjunction with the accompanying drawings, in which.

BEST MODE FOR CARRYING OUT THE INVENTION

Figure 1:
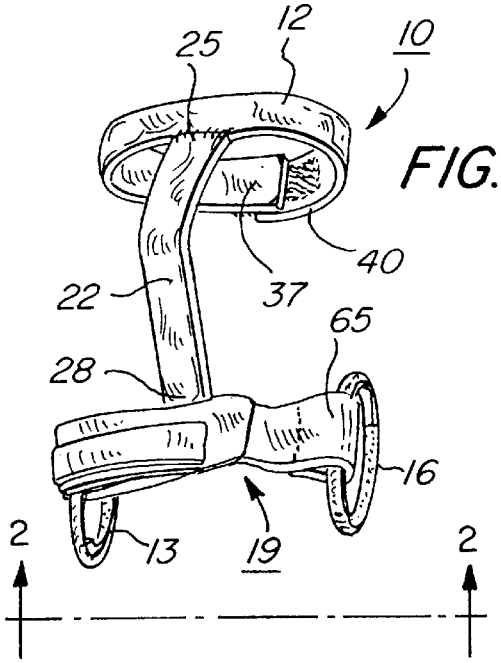
FIG. 1 is perspective view of the gripping assistance device of the present invention.
Figure 2:
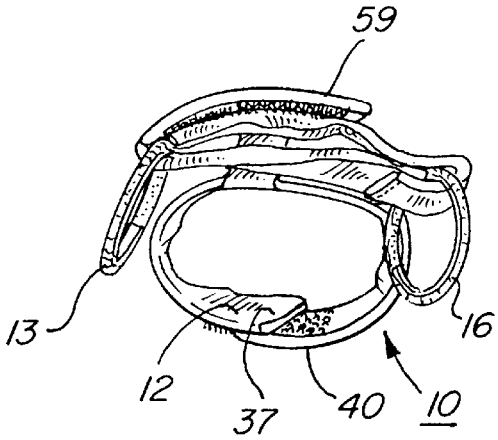
FIG. 2 is an end view of the gripping assistance device taken generally along line 2—2 in FIG. 1.
Figure 3:
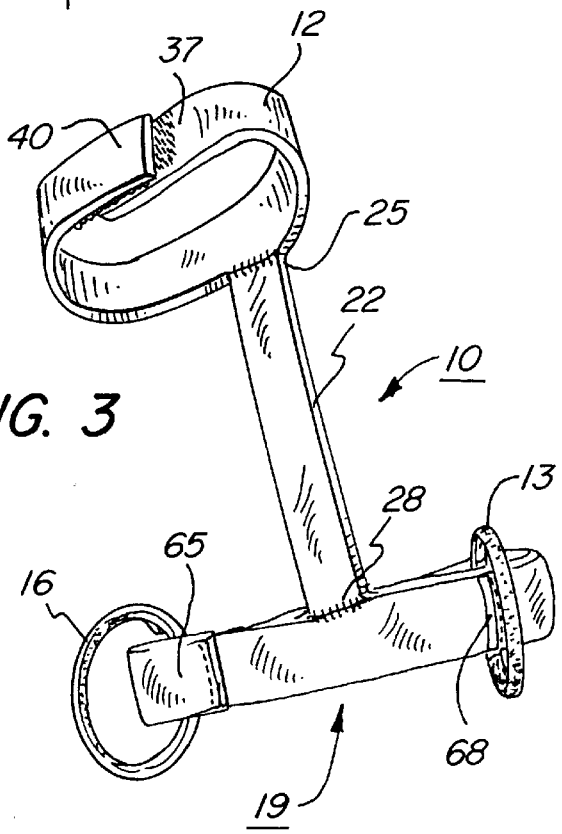
FIG. 3 is another perspective view of the gripping assistance device wherein the device shown in FIG. 1 has been rotated 180 degrees about an imaginary longitudinal axis (not shown) of the connecting strip 22.

FIGS. 1–3 show a preferred embodiment of the gripping assistance device 10 of the present invention, which comprises a wrist-band 12, a first toy-loop 13, a second toy-loop 16, a hand-strap 19 for connecting the first and second toy-loops 13, 16, and a connecting strip 22, which provides a means for connecting the hand-strap 19 to the wrist-band 12.

As shown in FIGS. 1–3, the wrist-band 12 is attached to a first end 25 of the connecting strip 22 such that when an infant's wrist is disposed within the wrist-band 12, the connecting strip extends from the wrist-band 12 toward the infant's finger tips along a line which is substantially in-line with the infant's forearm. A second end 28 of the connecting strip 22 is attached to the hand-strap 19.

The hand-strap 19 provides locations for attaching the first and second toy-loops 13, 16. The first and second toy-loops 13, 16 provide a means by which different portions of a toy 31 or other object may be disposed within the toy-loops 13, 16 (as shown in FIGS. 4 and 5), and permit the infant's hand 34 to be disposed between the toy 31 and the hand-strap 19.

Figure 6:
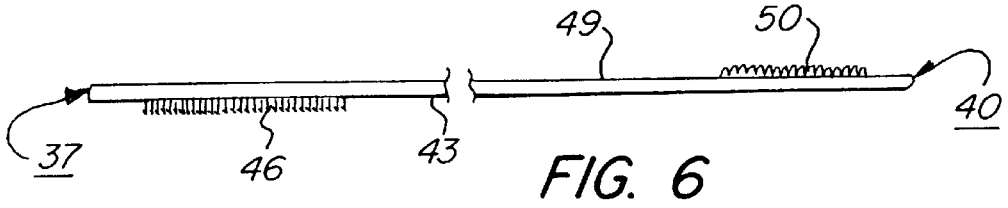
FIG. 6 is an end view of the wrist-band of the gripping assistance device.

In a preferred embodiment of the wrist-band 12 shown in FIG. 6, the wrist-band 12 comprises a strip of flexible material having a first end 37 and a second end 40. The flexible material is preferably, but not necessarily strapping material such as that marketed under the registered trademark Velfoam® by Smith & Nephew Rolyan Inc. of Germantown, Wis. and is commonly used by physical and occupational therapists. Attached near the first end 37 on the underside 43 of the wrist-band 12 is a piece of material 46 having a plurality of small flexible hooks, such as that found in a piece of hook and loop fastener, commonly marketed under the registered trademark Velcro®. Attached near the second end 40 on the topside 49 of the wrist-band 12 is a piece of material 50 having a plurality of small loops, such as that also found in a piece of hook and loop fastener. It should be noted that if the preferred material for the wrist-band 12 discussed above is used, the piece of material 50 having a plurality of small loops may be omitted since the preferred material for the wrist-band 12 has a plurality of small loops which will engage the small flexible hooks of the piece of material 46.

Figure 4:
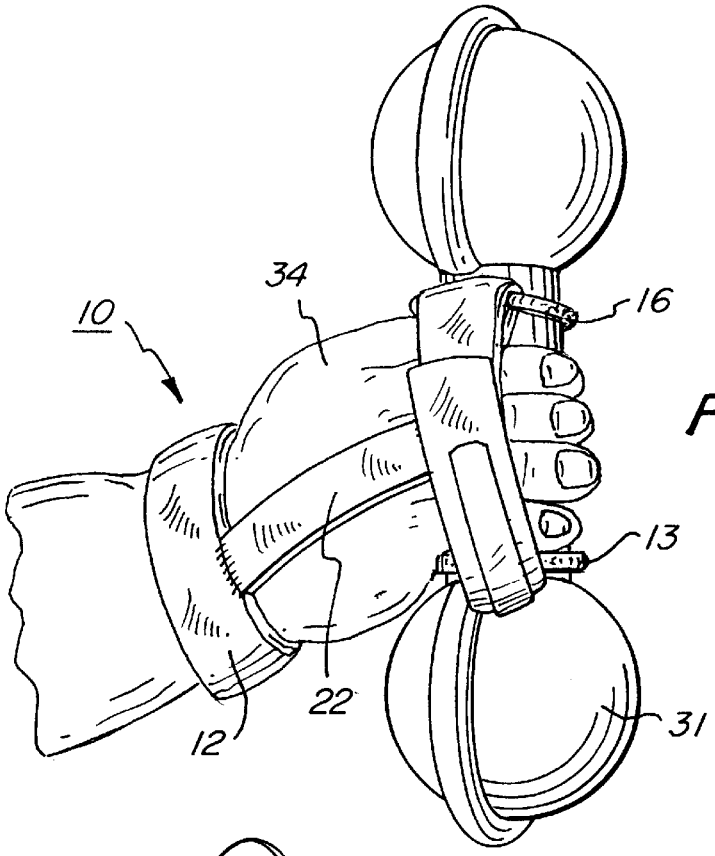
FIGS. 4 and 5 are perspective views of the gripping assistance device showing how an infant's wrist and hand are positioned with respect to the gripping assistance device and a toy attached thereto so as to assist the infant in gripping the toy.
Figure 5:
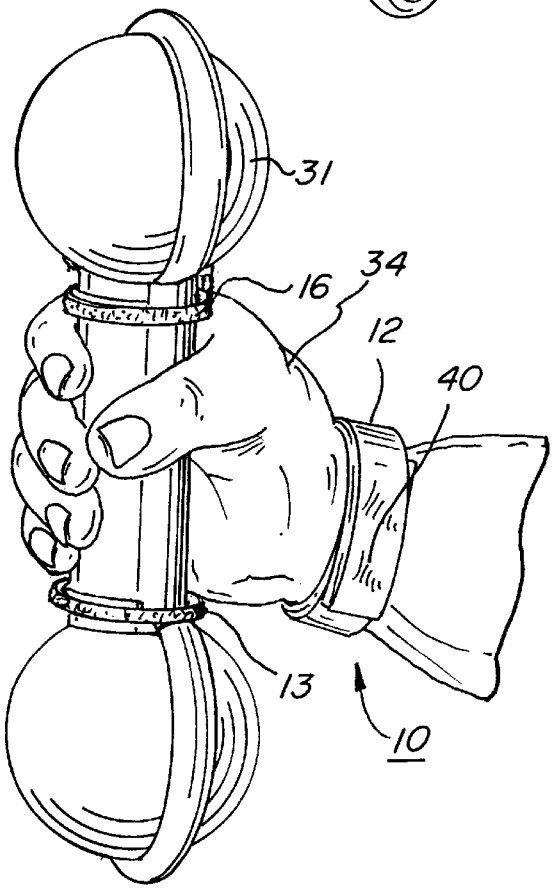

When the infant's wrist is contacting the topside 49 of the wrist-band 12 as shown in FIG. 4, the first and second ends 37, 40 of the wrist-band 12 are wrapped around the wrist such that the piece of material having small flexible hooks 46 faces away from the wrist, and the piece of material having small loops 50 faces toward the wrist. In this manner, the wrist is prevented from contacting the material with the small flexible hooks 46, which may scratch skin. Upon pressing the material with the small flexible hooks 46 against the material with the small loops 50 so as to engage the small flexible hooks with the small loops, the wrist-band 12 removably encircles the infant's wrist.

If the connecting strip 22 is too long, the connecting strip 22 may be rolled around the wrist-band 12 prior to placing the wrist-band 12 around the infant's wrist. In this manner, the gripping assistance device 10 may be adjusted to fit differently sized hands.

Figure 7:
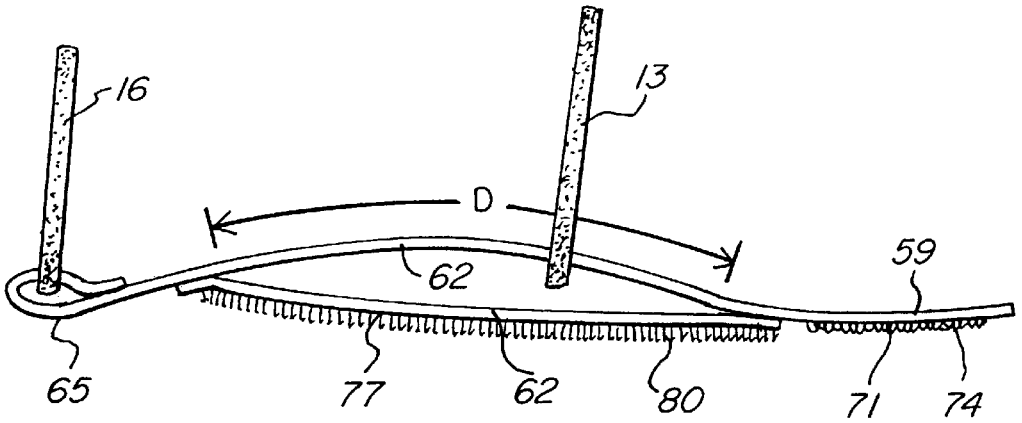
FIG. 7 is an end view of the hand-strap showing how the toy-loops interlock with the hand-strap.
Figure 8:
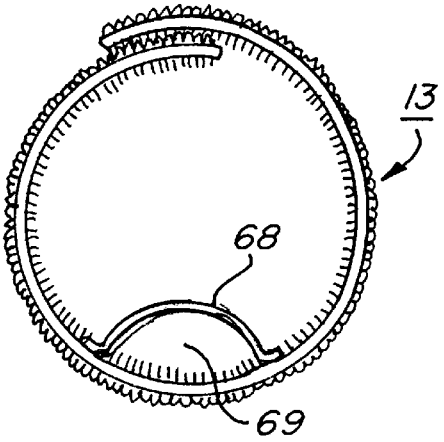
FIG. 8 is an end view of the first toy-loop, showing the bridging material.

In the preferred embodiment of the hand-strap 19 shown in FIG. 7, the hand-strap 19 comprises one or more pieces of flexible material, and may be made from the same material as the wrist-band 12. The hand-strap 19 has a tab portion 59, a first loop portion 62 and a second loop portion 65. The first loop portion 62 is disposed between the tab portion 59 and the second loop portion 65. The first toy-loop 13 and the first loop portion 62 are interlocked with one another. The second toy-loop 16 and the second loop portion 65 are also interlocked with one another. As shown in FIG. 8, the first toy-loop 13 may further comprise a bridging material 68 for disposing the first loop portion 62 between the first toy-loop 13 and the bridging material 68 in the opening 69. The bridging material 68 preferably comprises an elastic material such as elasticized fabric. When provided with the bridging material 68, the first toy-loop 13 may be held at a desired location on the first loop portion 62. In addition, for safety and convenience, the first toy-loop 13 is prevented from being removed from the first loop portion 62 by the bridging material 68.

In the preferred embodiment, as shown in FIG. 7, connected to the underside 71 of the tab portion 59 of the hand-strap 19 is a piece of material 74 having a plurality of small loops, such as that found in a piece of hook and loop fastener. Connected to the underside 77 of the first loop portion 62 is a piece of material 80 having a plurality of small flexible hooks, such as that also found in a piece of hook and loop fastener. By positioning the material having small loops 74 and the material having small hooks 80 in this manner, the tab portion 59 can be removably attached to the first loop portion 62, and the distance D that the first toy-loop 13 is permitted to travel is thereby reduced. In addition, the tab portion 59 may be conveniently stored out of the way without reducing the distance D, if the user so desires.

Figure 9:
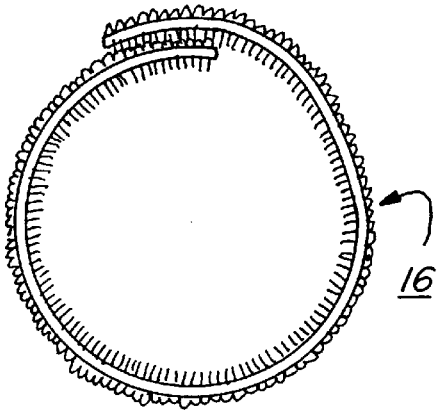
FIG. 9 is an end view of the second toy-loop.

In a preferred embodiment of the toy-loops 13, 16, shown in FIGS. 8 and 9, the toy-loops 13, 16 comprise back-to-back hook and loop fastener material (also commonly marketed under the registered trademark Velcro®), having the hook-side facing the toy 31 and the loop-side facing away from the toy 31. By facing the hook-side of the hook and loop fastener material toward the toy 31, the infant is prevented from contacting the hooks, which may scratch skin. Furthermore, by using the back-to-back hook and loop material, the toy-loops 13, 16 are easily and cheaply manufactured and provide quick removal of the toy 31 from the gripping assistance device 10.

As shown in FIGS. 4 and 5, to properly use the gripping assistance device 10 of the present invention, different portions of the toy 31 are disposed within the first and second toy-loops 13, 16, the infant's hand 34 is disposed between the hand-strap 19 and the toy 31 such that the palm of the infant's hand 34 faces the toy 31, and the infant's wrist is disposed within the wrist-band 12. It should be noted that the hand-strap 19 is not disposed between the infant's hand 34 and the toy 31. By positioning the toy 31 and the infant's hand 34 in this manner, the toy 31 is kept near the palm of the infant's hand.

When the infant releases the toy 31 the wrist-band 12 and hand-strap 19 keep the toy 31 in close proximity to the infant, thereby assisting, encouraging and teaching the infant to again grip the toy 31. The toy-loops 13, 16 may be sized to keep the toy 31 at a desired distance from the infant's hand 34 when the infant is not gripping the toy 31. Alternatively, if desired, the toy-loops 13, 16 may be sized to keep the toy 31 in contact with the infant's hand 34 when the infant is not gripping the toy 31.

Although the present invention has been described with respect to one or more particular embodiments of the device, it will be understood that other embodiments of the present invention may be made without departing from the spirit and scope of the present invention. Hence, the present invention is deemed limited only by the appended claims and the reasonable interpretation thereof.

I claim:

1. A gripping assistance device for assisting an infant to grip an object, comprising:

a first object-loop, for engaging a first portion of the object;

a second object-loop, for engaging a second portion of the object;

a hand-strap, connecting the first and second object loops, the hand strap comprising an adjusting tab, a first hand-strap loop in contact with the adjusting tab and interlocked with one of the object-loops, and a second hand-strap loop in contact with the first hand-strap loop and interlocked with a different one of the object loops;

a wrist-band;

a connecting strip, connecting the wrist band to the hand-strap; and the first hand-strap loop having means for increasing and decreasing it's circumference so as to adjust the length of the hand-strap, whereby the hand-strap is made to rest under adjustable tension across only one side of a hand of the infant, thereby allowing the infant to wear the gripping assistance device and grip the object with the object directly contacting the palm of the infant's hand.

2. The device of claim 1 wherein the wrist-band comprises:

a strip of flexible material having a first end and a second end;

a first piece of material having a plurality of hooks attached near the first end of the strip of flexible material; and a second piece of material having a plurality of loops attached near the second end of the strip of flexible material, for engaging the hooks of the first piece of material so as to permit an infant's wrist to be removably encircled by the wrist-band.

3. The device of claim 1 wherein the wrist-band comprises:

a strip of flexible material having a plurality of loops;

a piece of material having a plurality of hooks attached to the strip of flexible material for engaging the loops of the strip of flexible material so as to permit an infant's wrist to be removably encircled by the wrist-band.

4. The device of claim 1 wherein the means for increasing or decreasing it's circumference includes:

a first piece of material having a plurality of fastener hooks attached to the first hand-strap loop; and a second piece of material having a plurality of fastener loops attached to the adjusting tab, for engaging the fastener hooks of the first piece of material so as to permit the adjusting tab to be removably fastened to the first hand-strap loop.

5. The device of claim 1 wherein the device further comprises a bridging material having a first end and a second end both of which are attached to the first object-loop for disposing the hand-strap between the bridging material and the first object-loop.

6. The device of claim 1 wherein the first object-loop comprises a strip of object-loop material, the object-loop material having a plurality of fastener hooks on a first side and a plurality of fastener loops on a second side so that when the object-loop material is formed into a loop, the hooks on the first side of the object-loop material engage the loops of the second side of the object-loop material to hold the object-loop material in the form of a loop.

7. A gripping assistance device for assisting an infant to grip an object, comprising:

a means for attaching the object to the device;

a hand-strap attached to the means for attaching the object to the device, the hand-strap having a first hand-strap loop and a second hand-strap loop;

a wrist-band for removable attachment to an infant's wrist;

a connecting strip having a first end and a second end, and attached to the wrist-band at the first end of the connecting strip and attached to the hand-strap at the second end of the connecting strip; and one of the first or second hand-strap loops having means for decreasing or increasing it's circumference so as to adjust the length of the hand-strap, whereby the hand-strap is made to rest under adjustable tension across only one side of a hand of the infant, thereby allowing the infant to wear the gripping assistance device and grip the object directly contacting the palm of the infant's hand.

8. The device of claim 7 wherein the means for attaching comprises an object-loop.

9. A gripping assistance device for assisting an infant to grip an object, comprising:

a first object-loop, for engaging a first portion of the object;

a second object-loop, for engaging a second portion of the object;

a hand-strap, connecting the first and second object-loops, the hand-strap having a first hand-strap loop and a second hand-strap loop;

a wrist-band;

a connecting strip, connecting the wrist-band to the hand-strap at a position on the hand-strap between the first and second object-loops; and one of the first or second hand strap loops having means for increasing or decreasing it's circumference so as to adjust the length of the hand-strap, whereby the hand-strap is made to rest under adjustable tension across only one side of a hand of the infant, thereby allowing the infant to wear the gripping assistance device and grip the object with the object directly contacting the palm of the infant's hand.

10. The device of claim 9 wherein the wrist-band comprises:

a strip of flexible material having a first end and a second end;

a first piece of material having a plurality of fastener hooks attached near the first end of the strip of flexible material; and a second piece of material having a plurality of fastener loops attached near the second end of the strip of flexible material, for engaging the fastener hooks of the first piece of material so as to permit an infant's wrist to be removably encircled by the wrist-band.

11. The device of claim 9 wherein the wrist-band comprises:

a strip of flexible material having a plurality of fastener loops;

a piece of material having a plurality of fastener hooks attached to the strip of flexible material for engaging the fastener loops of the strip of flexible material so as to permit an infant's wrist to be removably encircled by the wrist-band.

12. The device of claim 9 wherein the first hand-strap loop is interlocked with one of the object-loops.

13. The device of claim 12 wherein the hand-strap further comprises an adjusting tab and wherein the means for increasing or decreasing it's circumference connects the adjusting tab to the first hand-strap loop.

14. The device of claim 13 wherein the means for increasing or decreasing it's circumference is comprised of a plurality of fastener hooks and a plurality of fastener loops for engaging the plurality of fastener hooks.

15. The device of claim 12 wherein the second hand-strap loop is interlocked with a different one of the object loops.

16. The device of claim 9 wherein the device further comprises a bridging material having a first end and a second end both of which are attached to the first object-loop for disposing the hand-strap between the bridging material and the first object-loop.

17. The device of claim 9, wherein the first object-loop comprises a strip of object-loop material, the object-loop material having a plurality of fastener hooks on a first side and a plurality of fastener loops on a second side so that when the object-loop material is formed into a loop, the fastener hooks on the first side of the object-loop material engage the fastener loops of the second side of the object-loop material to hold the object-loop material in the form of a loop.

* * * * *

UNITED STATES PATENT AND TRADEMARK OFFICE

CERTIFICATE OF CORRECTION

PATENT NO. : 5,957,515

DATED : September 28, 1999

INVENTOR(S) : Van Der Sluys

It is certified that error appears in the above-identified patent and that said Letters Patent is hereby corrected as shown below:

At column 4, line 57,

At column 5, lines 17 and 53

At column 6, lines 10, 44, and 47,

"it's" should read --its--.

Signed and Sealed this

Twenty-third Day of May, 2000

*Attest:*

*Attesting Officer*

Q. TODD DICKINSON

*Director of Patents and Trademarks*